United States Patent [19]

Irani et al.

[11] 4,036,732

[45] July 19, 1977

[54] TAR SANDS EXTRACTION PROCESS

[75] Inventors: Cyrus A. Irani, Westfield; Edward W. Funk, Linden; Ernesto Gomez, Elizabeth; Ramon L. Espino, Summit, all of N.J.

[73] Assignee: Exxon Research and Engineering Company, Linden, N.J.

[21] Appl. No.: 547,640

[22] Filed: Feb. 6, 1975

[51] Int. Cl.[2] ..... C10G 1/04

[52] U.S. Cl. ..... 208/11 LE

[58] Field of Search ..... 208/11 LE

[56] References Cited

U.S. PATENT DOCUMENTS

| | | | |
|---|---|---|---|
| 2,871,180 | 1/1959 | Lowman et al. | 208/11 |
| 2,885,339 | 5/1959 | Coulson et al. | 208/11 |
| 2,965,557 | 12/1960 | Price | 208/11 |
| 3,475,318 | 10/1969 | Gable et al. | 208/11 |
| 3,542,666 | 11/1970 | Simpson | 208/11 |
| 3,553,099 | 1/1971 | Savage et al. | 208/11 |

*Primary Examiner*—Delbert E. Gantz
*Assistant Examiner*—James W. Hellwege
*Attorney, Agent, or Firm*—Robert J. Baran; Joseph J. Allocca

[57] ABSTRACT

This invention relates to a process for the extraction of bitumen from tar sands which comprises contacting the tar sand in an extraction zone with a paraffinic hydrocarbon solvent having from 5 to 9 carbon atoms at a ratio of from 2 to 10 parts solvent per part of bitumen present in the tar sand, maintaining the asphaltene fraction of said tar sands in suspension, separating a major portion of said solvent which contains a major amount of the bitumen dissolved therein along with the suspended asphaltene fraction from the extracted sand, passing the extracted sand along with a minor portion of said solvent and a minor amount of bitumen into a water contacting zone and therein contacting said extracted sand with sufficient water at a temperature of at least 100° F. to separate substantially all of said minor amount of bitumen and said minor portion of solvent from said sand, separating said major solvent portion from the suspended asphaltenes and distilling said solvent from said major solvent portion to recover said major amount of bitumen. In a preferred embodiment, the extract from the water contacting zone is centrifuged to separate fines and water from the bitumen and solvent, said minor amount of bitumen is removed from the solvent, e.g., by distillation and may be burned to provide heat for the process. The process of the instant invention contemplates separating said minor amount of bitumen as a low metals bitumen fraction, thus useful as a clean burning fuel. The metal contaminants of the tar sand are removed with the asphaltenes and discarded. Asphaltenes are defined throughout the specification as that fraction of tar which is insoluble in n-heptane and soluble in benzene at room temperature.

7 Claims, 1 Drawing Figure

FIGURE I
TAR SANDS EXTRACTION PROCESS
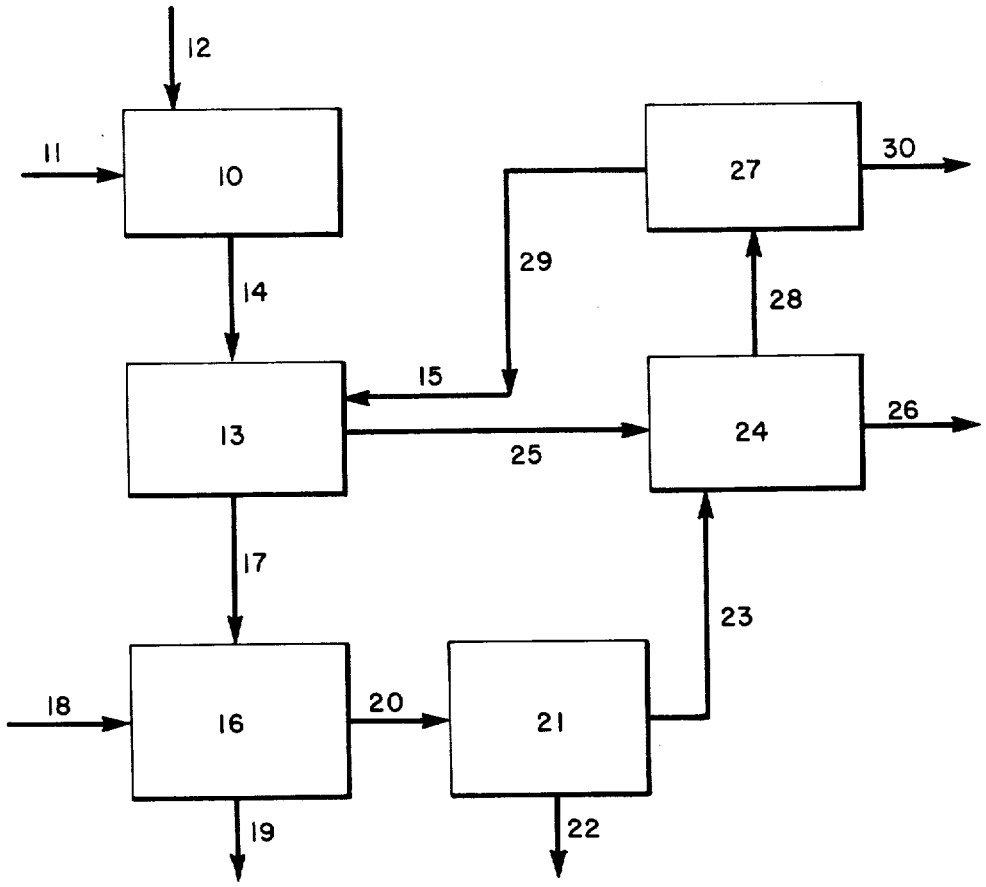

TAR SANDS EXTRACTION PROCESS

FIELD OF THE INVENTION

This invention relates to a process for the extraction of bitumen from tar sands which comprises contacting the tar sand in an extraction zone with a paraffinic hydrocarbon solvent having from 5 to 9 carbon atoms at a ratio of from 2 to 10 parts solvent per part of bitumen present in the tar sand, maintaining the asphaltene fraction of said tar sands in suspension, separating a major portion of said solvent which contains a major amount of the bitumen dissolved therein along with the suspended asphaltene fraction from the extracted sand, passing the extracted sand along with a minor portion of said solvent and a minor amount of bitumen into a water contacting zone and therein contacting said extracted sand with sufficient water at a temperature of at least 100° F. to separate substantially all of said minor amount of bitumen and said minor portion of solvent from said sand, separating said major solvent portion from the suspended asphaltenes and distilling said solvent from said major solvent portion to recover sid major amount of bitumen. In a preferred embodiment, the froth from the water contacting zone is centrifuged to separate fines and water from the bitumen and solvent, said minor amount of bitumen is removed from the solvent, e.g., by distillation, and may be burned to provide heat for the process. The process of the instant invention contemplates separating said minor amount of bitumen as a low metals bitumen fraction, thus useful as a clean burning fuel. The metal contaminants of the tar sand are removed with the asphaltenes and discarded. Asphaltenes are defined throughout the specification as that fraction of tar which is insoluble in n-heptane and soluble in benzene at room temperature.

BACKGROUND OF THE PRIOR ART

Tar sands or bituminous sands are well known in various parts of the world. Most important deposits have been discovered in Alberta, Canada, along the Athabasca River. These particular tar sand are known as Athabascan tar sands and contain a large amount of the world's known reserves of crude oil. These tar sands may generally be characterized as comprising particles of silica surrounded by a water envelope which is in turn surrounded by the tar. The tar sands may additionally contain various forms of silt and clay. In general, tar sands may contain from 5 to 21% by weight of oil which may vary from 6 to 10 API gravity. It has been difficult to separate the oil from tar sands and in the past the economy of the process was the most critical parameter for commercialization. There have been two methods in use for the separation of tar sands; the hot water process and the cold water process. The hot water process relies on jetting steam and a minor amount of hot water at a temperature of 170° to 190° F. through ground up tar sands to form a slurry. In this process, the sand settles to the bottom of the slurry while the oil rises to the top in the form of a froth which is separated as an emulsion of the oil and the water. The breaking of this emulsion so as to recover the oil has caused great difficulty with this process.

In the cold water method, as, for example, disclosed in U.S. Pat. Nos. 2,825,677 and 3,041,267 a solvent is first added to the ground up tar sand to dissolve the bitumen. This solvent slurry is then introduced into a large volume of water which may comprise a salt or a surface active agent. The oil is then separated along with the solvent from the water and sand by pressure or gravity.

More recent developments in separating the bitumen from tar sand have relied on the use of solvent systems, including single solvents, multistep processes where the tar sand is contacted with different solvents in serial steps, and multisolvent systems where the solvent is tailored to dissolve the bitumen along or the bitumen along with the asphaltenes. The various solvent processes, as stated above, either remove all of the oil by extraction with an aromatic solvent or a bitumen portion, only, by extraction with a paraffinic type solvent. For example, in U.S. Pat. No. 3,475,318, a process is taught for extracting a bitumen low in asphaltenes by using a saturated hydrocarbon solvent having from 5 to 9 carbon atoms per molecule, or alternatively adding up to 20% of an aromatic having from 6 to 9 carbon atoms per molecule to separate the asphaltenes along with the bitumen. In a later step of the invention, these asphaltenes must be separated from the solvent-bitumen fraction. It is noted that the patentee teaches that the bitumen, if present, in admixture with asphaltenes must be vacuum flashed in an additional separation step. Furthermore, the patentee, since he relies on a filtering operation, to separate the oil from the sand does not recognize the advantage of separating the asphaltenes from the sand in other than a dissolved form. See also U.S. Pat. No. 3,459,653 which teaches use of a deasphalting solvent to remove bitumens and leave asphaltenes on the sand.

It should be noted that when the asphaltenes are left on the sand, steam must be used to separate the solvent associated with the sand. The use of warm water, as disclosed below in the description of the instant invention results in the formation of stable emulsions, from which the solvent is difficult to recover.

Other tar sand extraction processes which rely on aromatic solvents to remove substantially all the bitumens and asphaltenes, in a single step, from the sand include those described in U.S. Pat. No. 2,965,557 wherein gasoline is used to remove the oil from the sand; U.S. Pat. No. 3,117,922 wherein a heavy oil high in aromatic content is used and the patentee is careful not to form an asphaltene phase in his extraction step; U.S. Pat. No. 3,392,105 wherein the patentee mixes gasoline, isopropanol and water to create a slurry, said slurry being further diluted with gasoline, isopropanol, phenol, furfural, liquefied petroleum gases, etc.; and U.S. Pat. No. 3,553,099 wherein toluene is used to extract the oil from the sand and thus substantially all the oil associated with the sand is separated as a solution from said sand.

In an article by D. L. Mitchell et al, FUEL, 1973, Vol. 52, April, pages 149–152, the solubility of asphaltenes in various solvent is disclosed. It is noted in the article that aromatic solvents dissolve all asphaltenes while the paraffinic solvents do not.

In U.S. Pat. No. 2,871,180 a process is disclosed wherein tar is separated from tar sands in two fractions. The patentee pulps the tar sand with water and steam to disrupt the oil and water phase which surrounds the sand particles and then contacts the pulped sand with a deasphalting solvent which contains less than 6 carbon atoms. The asphaltene phase separates from the deasphalting solvent-bitumen phase by gravity, the asphaltene phase being present as a liquid phase comprising a substantial amount of the bitumen associated therewith.

The sand and water are removed from the bottom of a settling tower while the oil is removed from the tower in the two fractions described. The patentee recommends the use of propane, thus allowing the asphaltenes to take a certain amount of the bitumen along therewith. Furthermore, since the patentee teaches the breaking of the water envelope during the pulping of the sand, he loses a substantial amount of solvent along with his sand and water. Finally, it is known in the art that the use of propane in the extraction of bitumen requires high pressure and temperature conditions, thus necessitating increased expenditures for the special equipment used in carrying out the process.

SUMMARY OF THE INVENTION

This invention relates to a novel process for the extraction of oil from tar sands which may be conveniently understood by reference to FIG. 1 which describes a preferred embodiment thereof. In this process, the tar sand is first stripped of overburden, mined by any appropriate means, and brought to an extraction plant for removal of the oil from the sand and water. The mined tar sand is first fed into a crusher or a series of crushers (not shown) where it is crushed, broken or ground into appropriate sizes for the solvent extraction step. Generally the particles may have a diameter of about 0.02 to 1 mm. It is noted that, as further described below, since a filtering process is not used for the separation of the oil from the sand, tar sands having particles sizes of less than 200 mesh, unlike the process described in U.S. Patent 3,475,318 above, may be advantageously extracted. The crushed tar sand is passed through conduit (11) from the crusher to the slurry zone (10) wherein it is mixed with a small amount of water, added via conduit (12), which advantageously may contain some phenol or other compound capable of undergoing hydrogen bonding with water so as to preserve the envelope of water around the sand and thus limit loss of solvent with the sand in subsequent steps to be described below. The addition of water also promotes increased settling rates of the tar sand particles during the subsequent solvent extraction step.

In general, approximately from about 1 to 10% by weight, e.g., about 5% water based on tar sand, will be mixed with the tar sand at this stage. The water may contain from about 0.02 to 3% by weight phenol or other compound capable of undergoing hydrogen bonding and orienting itself at the water-hydrocarbon interface. The tar sand is mixed under conditions of mild agitation in this slurry zone so as to avoid disrupting the water envelope around the sand. The tar sand is then passed to an extraction zone (13) via conduit (14) wherein from 2 to 10, preferably from 1 to 5, most preferably from 4 to 5 parts, per part bitumen in the tar used of a paraffinic solvent comprising compounds having from 5 to 9 carbon atoms, brought into said solvent extraction zone via conduit (15), are contacted with the slurried tar sand. In this contacting zone, the tar sand in slurry form may be contacted countercurrently or the solvent extraction may be single stage. The above ratios of solvent and tar sand slurry are contacted, in any event, under conditions of mild agitation to preserve the water envelope associated with the sand. In this extraction zone, the temperatue will be maintained at from 10° to 80° C, preferably from 20° to 50° C. Conveniently ambient temperature as well as pressure is used. The contacting of the aqueous tar sand slurry with the solvent, which, because of its balance of low volatility and solvent properties, is preferably normal heptane, may be from 0.1 to 10 minutes, more preferably from 2 to 5 minutes. It is a critical feature of this invention that after the extraction step three separate phases exist in the extraction zone. In one phase, a major amount of the bitumen present in the tar sand will be dissolved in a major portion of the solvent. A second phase will comprise the asphaltenes which are substantially insoluble in said solvent. The third phase will comprise the sand along with a major portion of the added water and the water originally present in the tar sands, as well as a minor amount of bitumen and solvent. The contacting in the extraction zone is carried out so as to avoid the formation of an emulsion. The sand is moved, by means known in the art, to a water contacting zone (16), through conduit (17) wherein a large excess of water, brought in through conduit (18) is contacted with the sand. In a less preferred alternative the sand may be left in the first zone (13), and after removal of the major solvent-bitumen phase, treated with water to remove solvent and oil from the sand. The contacting of the sand and the excess water may be conveniently done in a countercurrent manner. The amount of water added is just enough to remove substantially all the oil and solvent from the sand. In general, from ½ to 1 part of water per part of sand is contacted with the sand in this water contacting zone. This additional water is added at a temperature of at least 50° C, preferably from 60° to 80° C. It has been found that if care has been taken not to disrupt the water envelope prior to this step that steam does not have to be added in this stage to completely remove the solvent from the sand. Furthermore, since the surface active asphaltenes have been removed there is no danger of the formation of emulsions of the solvent-oil and water. In this stage, the solvent associated with the sand as well as the minor portion of the bitumen, which has not been extracted in the extraction zone, is removed. In general, the agitation in the water contacting zone cuses the bitumen and the solvent along with some of the smaller particle size fines, especially clay present from the original tar sand, to separate as a froth. This froth may be conveniently separated by means known in the art from this water contacting zone. For example, the froth may be separated at the top of the water contacting zone by overflow, e.g., a weir, or the equivalent thereof. The sand along with a major portion of the water will be separated at the bottom through conduit (19), and discarded. The sand at this stage will be substantially clean, that is less than 1% by weight of the total solvent and less than 2% by weight of the total bitumen present in the tar sand will remain with the sand. The froth, which contains solvent, fines, bitumen and water, is preferably removed through conduit 20 to a centrifuging zone (21) or a settler. The fines, such as clay, and the water will be removed from the froth, via conduit (22) leaving behind solvent and bitumen. In general, this bitumen fraction will comprise from about 5 to 20% by weight of the total bitumen present in the tar sands. The amount of solvent recovered in zone 21 is less than 10%, preferably less than 5%, by weight of the total solvent passed into the solvent extraction zone.

The solution of said bitumen and solvent after separation from the fines and water in zone 21 may be passed directly to zone 24 via conduit 23 wherein the asphaltenes are removed from said solution of the major portion of bitumen in the major portion of the solvent obtained in the solvent extraction zone. The operation in this zone is described further below.

It is one feature of this invention that the sand removed in the manner described above from the water contacting zone is very clean and may be returned to the environment without further treatment. It is a further feature of this invention that the sand is provided in this very clean state without the need for steaming to remove either solvent or tar fractions. Thus, the economy of this process will be evident to those skilled in the art.

The other two phases which are separated from the solvent extraction zone (13) comprise a major portion of the bitumen dissolved in a major portion of the solvent provided to said extraction zone. Additionally, this solution will contain suspended asphaltenes. One feature of the invention is that the asphaltenes are substantially removed from the tar sands, i.e., greater than 85% by weight of the asphaltenes present in the original tar sands are removed at this point, but they are in a form where they can be easily separated from the desired bitumen fraction. This asphaltene suspension is passed into a separation zone (24) via conduit 25, wherein the asphaltenes may be separated due to their higher specific gravity.

In the preferred embodiment, the asphaltenes are separated by use of a conventional settling tank. It has been found that asphaltenes settle slowly from a heptane solution, but this rate of settling can be increased by increasing the temperature. For example, extraction with heptane at 20° C. followed by settling at 90° C. gives rapid separation of asphaltenes from the deasphalted bitumen. The increased settling at higher temperatures is due to a decrease in solvent viscosity and also formation of larger asphaltene aggregates.

In a less preferred embodiment of the settling separation, a temperature is used that is above the melting point of the asphaltenes, e.g. 150° C. In this instance, two distinct liquid phases are formed. These can be separated using conventional chemical processing equipment.

After separation in zone 24, the major bitumen phase which is dissolved in the majority of the solvent is moved to zone 27, via conduit 28 where the solvent is separated and the bitumen reclaimed. Preferably, the solvent is distilled overhead from the bitumen and returned via conduit 29 to the solvent extraction zone for re-use. The deasphalted bitumen may be recovered via conduit 30 for cycling to further oil upgrading processes such as hydrocracking, hydrogenation, reformation, etc.

It has been found that the process of the instant invention allows recovery of 97% or more of the bitumen present in the tar sands of which 83% or more of which is recovered as a high-grade fraction (the major portion described above). The difference, that is 14% bitumen, which differs from the initial fraction as described above is still of a significantly high grade as to be conveniently burned for energy to supply to the process. The major amount of bitumen will contain less than 130 ppm of vanadium, 65 ppm of iron, and 65 ppm of nickel; these are important criteria for downstream processing. Solvent losses in this process are as little as 0.7% by weight or less in one cycle. The following is a specific embodiment of the instant invention.

EXAMPLE 1

500 grams of fresh tar sands from Mildred Lake were sprayed with 25 ml of aqueous solution containing 200 ppm of phenol. This slurry was then contacted with normal heptane at a solvent/bitumen weight ratio of 4 and a temperature of 25° C. After 3 minutes contacting time, the liquid extract was withdrawn. The remaining sand, with residual solvent and bitumen, was contacted with 500 ml of water at 55° C. The water displaced the bitumen and solvent giving an oil phase above the water phase with no intermediate emulsion phase. Clean sand formed below the water phase. It was found that 2.3% of the total bitumen was lost with the sand and that 0.4% of the total heptane was lost. The bitumen layer from the water wash was centrifuged sufficiently to remove sand and water and was then combined with the liquid extract from the heptane contacting. Subsequent centrifugation of this extract at 27° C. and 1700 rpm removed small quantities of clay and 9.54 grams of asphaltenes (corresponding to 14.9% of the total bitumen). These asphaltenes have a Conradson carbon of 35%, a V content of 640 ppm, a Ni content of 350 ppm and a Fe content of 500 ppm. Following this centrifugation, heptane was removed from the dissolved bitumen by distillation and 56.99 grams of deasphalted bitumen were recovered (corresponding to 82.3% of the total bitumen). Table I shows the properties of this major bitumen fraction.

Table I

| Properties of Tar Sand Bitumens (Deasphalted) | |
|---|---|
| Gravity, ° API (60° F.) | 10.6 |
| Viscosity (100° F.) | 2986.0 cS |
| (210° F.) | 62.05 cS |
| V, ppm | 110 |
| Ni, ppm | 52 |
| Fe, ppm | 60 |
| Conradson Carbon | 9.5% |

These results show that the major bitumen fraction obtained in this invention is of a higher quality and can be used as a feed for hydrocarbon conversion processes.

EXAMPLE 2

1000 grams of fresh Athabasca tar sands from Mildred Lake were sprayed with 50 grams of cold water. These wet tar sands were then contacted with n-heptane at a 4/1 solvent to bitumen weight ratio and at 20° C. The liquid extract containing solvent, dissolved bitumen and suspended asphaltenes was then passed to a conventional settler. The extract was settled at 90° C. for 10 minutes: the liquid phase was then removed, and the solvent stripped off by distillation. The resulting deasphalted bitumen had a vanadium concentration of 113 ppm. In another run where the settling was carried out at 20° C, the resulting deasphalted bitumen had a 185 ppm vanadium concentration for the same settling time. The asphaltenes precipitated by settling at a temperature of 90° C. contain greater than 250 ppm of vanadium and also a small fraction of oils and resins entrained with the asphaltenes. The overall yield of deasphalted bitumen is 83% and of asphaltenes, 14%. The water wash step is the same as that used in Example 1 and again for water at 55° C. solvent losses are less than 1%, and bitumen losses below 3%. This example demonstrates that a deasphalted bitumen can be obtained by the process of this invention by using simple equipment and avoiding the use of centrifuges of filters.

EXAMPLE 3

The fresh tar sands were initially slurried with added water amounting to approximately 5% of the initial weight of the tar sands. The solvent was then added and the mixture agitated at 25° C. The liquid extract was then poured off the tar sand bed. Water at 55° C. was then added to the tar sands and again the mixture was well stirred. Clean sand fell to the bottom and a hydrocarbon phase formed above the water phase; no emulsion formed.

The hydrocarbon phases were centrifuged to remove the asphaltenes plus suspended fines and water. The hydrocarbon phase from the solvent extraction has only a small quantity of fines, and is free of sand. The hydrocarbon phase from the water wash is similar to the froth produced in the hot-water extraction process, except diluted by solvent. This phase contains both sand and water which are removed by centrifugation.

The water-washed sand was contacted with benzene to remove the residual solvent and bitumen. Bitumen losses were determined by weight and the solvent loss by chromatographic analysis.

Table II shows a summary of the experiments.

Table II

| Solvent | Solvent Bitumen | DAB* Asphaltenes | Solvent loss, % | Bitumen loss, % |
|---|---|---|---|---|
| Hexane | 4 | 5.6 | 0.4 | 2.3 |
| Heptane | 2 | 6.9 | 0.85 | 4.3 |
| Heptane | 3 | 5.5 | 1.02 | 2.7 |
| Heptane | 4 | 5.2 | 0.85 | 3.1 |
| Heptane | 5 | 5.0 | 0.86 | 2.1 |
| Heptane (dry) | 2 | 7.0 | 1.86 | 5.06 |

*Deasphalted Bitumen.

The following are the important conclusions:

1. High solvent recovery requires that the water envelope be maintained; this is the reason for the added water. Results in Table II show that for dry tar sands the solvent losses are high. This is due to the wetting of the sand by the solvent.

2. Solvent losses are based on the percent of total solvent used in the extraction. Thus the percent tends to decrease with increasing solvent/bitumen ratio. Hence it does not appear that solvent losses are related to the total amount of solvent used.

3. The split between DAB/asphaltenes changes with the solvent/bitumen ratio used in the extraction. Also the product characteristics change. (See Example 4 below).

EXAMPLE 4

As described above, the solvent extraction of tar sands yields a solution containing a DAB (deasphalted bitumen) dissolved in the solvent and the asphaltenes suspended.

The suspended insolubles (asphaltenes + inorganic fines) can be separated from the liquid extract using a conventional laboratory centrifuge. The solvent can then be removed and the resulting DAB analyzed.

There is a trade-off between the solvent/bitumen ratio used and the product quality; the higher the solvent/bitumen ratio used in the extraction, the better the quality of the resulting bitumen, but also the greater is the cost of the solvent recovery (distillation) from the bitumen. Table III shows the effect of the heptane/bitumen ratio on the vanadium concentration in the deasphalted oil. The best balance between product quality and solvent recovery costs occurs at a solvent/bitumen ratio of about 4.

Table III

| Heptane/Bitumen (weight ratio) | Vanadium Concentration (ppm) |
|---|---|
| 4.6 | 98 |
| 4.0 | 105 |
| 3.5 | 113 |
| 3.0 | 124 |
| 2.5 | 133 |
| 2.0 | 130 |
| 1.4 | 160 |

For the results shown in Table III, the liquid extract was centrifuged to remove asphaltenes before the solvent was stripped off and the bitumen sent for analysis; the asphaltenes had a vanadium concentration of 400+ ppm.

The effect of other paraffinic solvents on the product characteristics of the resulting DAB was also investigated. Generally the product quality increases with decreasing carbon number but also the yield of DAB decreases. For example, the DAB extracted using n-pentane has a vanadium concentration of 63 ppm while that for hexane is 80 ppm.

Settling tanks in place of centrifuges may be used to remove asphaltenes and fines from the DAB solution. This is a very inexpensive separation and avoids the problems involved in the removal of a sticky asphaltene-solids phase.

In these settling experiments (below) the extract (DAB+solvent+suspended asphaltenes) is allowed to set for a given time in a graduated cylinder. The majority of the liquid is then drained, the solvent stripped off, and the bitumen sent for analysis. The precipitate in the graduated cylinder is washed with toluene, solids removed by centrifuging, solvent stripped off, and the bitumen sent for analysis.

Table IV shows the results with a solvent/bitumen ratio of 4.

Table IV

Settling Experiments for Tar Sands at Solvent/Bitumen Ratio of 4

| Solvent | Settling Time, min. | V, ppm |
|---|---|---|
| Pentane (60° C) | 3 | 62 |
| Pentane (20° C) | 5 | 60 |
| Pentane (20° C) | 10 | 61 |
| Hexane (20° C) | 5 | 94 |
| Hexane (20° C) | 10 | 84 |
| Heptane (20° C) | 10 | 185 |
| Heptane (20° C) | 10 | 113 |

The main conclusions which may be drawn from Table IV are:

1. Asphaltenes settle more rapidly in lower carbon number solvents, i.e., pentane>hexane>heptane.

2. Increasing the temperature increases the rate of settling, due to formation of larger particles, and the solvent viscosity decreasing.

Thus, in a most preferred embodiment of the process of the instant invention, the extract from the solvent extraction zone is heated to a temperature of from 50° to 150° C during settling. Temperatures above 150° C should be avoided since at this temperature the asphaltenes begin to melt and go into solution, thereby decreasing the quality of the DAB.

What is claimed is:

1. In a process for the extraction of bitumen from tar sands, the improvement which comprises countercurrent contacting of the tar sands in an extraction zone with a solvent consisting essentially of paraffins having from 5 to 9 carbon atoms at a ratio of from 2 to 10 parts by weight solvent per part bitumen present in the tar sand, maintaining the asphaltene fraction of the tar sands in suspension in a solution of a major portion of the bitumen in the major portion of said solvent in said extraction zone, separating said solution along with the suspended asphaltenes from said extraction zone, separating said solution from said asphaltenes, passing said separated solution to a distillation zone and therein distilling off said solvent, passing extracted sand from said extraction zone along with a minor portion of said solvent and a minor portion of bitumen into a water contacting zone and therein contacting said extracted sand with sufficient water at a temperature of at least 100° F. to separate substantially all of the bitumen and the solvent from said sand.

2. The process of claim 1 wherein said bitumen and said solvent are separated from the water contacting zone as a froth and said froth is centrifuged to remove any fines present therein and said centrifuged froth which comprises a minor portion of the bitumen along with a minor portion of the solvent is passed to a distillation zone and therein distilling said solvent from said bitumen, returning said solvent to the extraction zone and recycling said bitumen as a fuel to provide heat to said process.

3. The process of claim 1 wherein said paraffinic solvent is normal pentane.

4. The process of claim 1 wherein said paraffinic solvent comprises a mixture of paraffins containing from 5 to 7 carbon atoms.

5. The process of claim 1 wherein said solution is separated from said asphaltenes by settling.

6. The process of claim 5 wherein the rate of settling is increased by heating said suspended asphaltene containing solution to a temperature of at least 90° C.

7. The process of claim 5 wherein said extraction is carried out at a temperature of about 20° C.

* * * * *